United States Patent [19]

Yoshizawa et al.

[11] 4,334,403

[45] Jun. 15, 1982

[54] SPINNING UNITS IN AN OPEN END SPINNING MACHINE

[75] Inventors: Toshio Yoshizawa, Chiryu; Osamu Suzuki; Yoshiaki Yoshida, both of Ohbu, all of Japan

[73] Assignee: Kabushiki Kaisha Toyoda Jidoshokki Seisakusho, Kariya, Japan

[21] Appl. No.: 156,856

[22] Filed: Jun. 4, 1980

[30] Foreign Application Priority Data

Jun. 6, 1979 [JP] Japan ..... 54/69950

[51] Int. Cl.[3] ..... D01H 15/02

[52] U.S. Cl. ..... 57/263; 57/80; 57/405

[58] Field of Search ..... 57/58.89-58.95, 57/78-81, 263

[56] References Cited

U.S. PATENT DOCUMENTS

| | | | |
|---|---|---|---|
| 3,354,626 | 11/1967 | Cizek et al. | 57/58.89 X |
| 3,404,524 | 10/1968 | Rajnoha et al. | 57/81 |
| 3,462,936 | 8/1969 | Boucek et al. | 57/58.89 X |
| 3,540,201 | 11/1970 | Susami et al. | 57/80 |

FOREIGN PATENT DOCUMENTS 53-19046 2/1978 Japan .

*Primary Examiner*—John Petrakes

*Attorney, Agent, or Firm*—Wenderoth, Lind & Ponack

[57] ABSTRACT

An open end spinning machine includes a plurality of spinning units. Each spinning unit includes a first yarn breakage sensing device assuming a yarn sensing, operative position, in which it contacts the yarn, when the spinning unit is in a normal spinning operation and an inoperative position, in which it is not in contact with the yarn, when the spinning unit is in a transient condition either from or to the normal spinning operation, and a second yarn breakage sensing device assuming a yarn sensing position at least when the spinning unit is in the transient condition. Upon occurrence of yarn breakage when the spinning unit is in the transient condition, such breakage is detected by the second yarn breakage sensing device and the supply of fibers to the associated spinning unit is interrupted by the second yarn breakage sensing device.

8 Claims, 8 Drawing Figures

SPINNING UNITS IN AN OPEN END SPINNING MACHINE

BACKGROUND OF THE INVENTION

This invention relates to spinning units in an open end spinning machine, and more particularly to the prevention of the spinning rotor in each spinning unit from being clogged by fibers fed thereinto.

Generally, in an open end spinning machine such as, for example, described in U.S. Pat. No. 3,354,626, each spinning unit includes means for feeding individually opened fibers into a spinning rotor, in which superatmospheric pressure is produced by rotation thereof. The opened fibers are formed into a yarn in the spinning rotor. The yarn is transported from the spinning rotor by a winding means. Also, in the above open end spinning machine, each of the fiber feeding means, yarn take-up means and yarn winding means is mounted on a separate driving shaft and a single motor drives these separate driving shafts through a rotation transmission mechanism including trains of gears. This motor also drives an endless belt, which is in frictional contact with spindles of the spinning rotors to rotate the same.

When the spinning machine is stopped, the fiber feeding means is first stopped to discontinue the supply of fibers to the spinning rotor, the take-up roller and winding roller are then stopped at a time when the yarn end resulting from breakage of the yarn still remains in the yarn take-up tube, which undergoes the suction effect of the subatmospheric pressure in the spinning rotor, so as to facilitate the simultaneous connection of the yarn endings in all of the spinning rotors on subsequent starting of the spinning machine. Finally, all the spinning rotors are stopped. On starting, all the spinning rotors start to rotate simultaneously, the yarn take-up rollers and winding rollers are then rotated in a reverse direction to push the yarn ends from the take-up tubes into the spinning rotors, while the fiber feeding means are operated to supply opened fibers into the spinning rotors thereby to allow them to be twisted into the reversed yarn ends. Thereafter, the take-up rollers and winding rollers are rotated in a normal, yarn winding direction.

In order to detect a possible yarn breakage during the normal spinning operation, each spinning unit is provided with a yarn breakage sensing device of the contact type allowing a yarn sensing lever thereof to be in contact the yarn to detect the breakage and to be maintained in this yarn sensing or detecting position by the yarn tension during the normal spinning operation. Typically, such a yarn breakage sensing device is illustrated in British Pat. No. 1,158,623.

With the yarn breakage sensing device of the type described above, the yarn sensing lever may not be maintained in the yarn detecting position, i.e., moved into a yarn breakage position, under the transient condition either from or to the normal spinning operation during which the spinning machine is stopping or starting by pushing down a stop push-button or a start push-button, since the yarn tension during such a transient condition is lower than that during the normal spinning operation. In order to eliminate this disadvantage of the above-described yarn breakage sensing device, heretofore, the yarn sensing lever has been designed to be forcibly moved into an inoperative position, in which it is not in contact with the yarn, by using for example an electromagnet during the transient conditions. However, since such a forced movement of the yarn detecting lever has been effected simultaneously in all of the spinning units, fibers would be supplied into not only spinning rotors in which the yarn end connecting operation has been favourably carried out, but also a spinning rotor in which the yarn end connecting operation has failed.

In the past, the number of rotations of spinning rotors was relatively low i.e. on the order of about 30,000 r.p.m., and therefore the fiber supply rate was low. Also, the spinning rotor had a relatively large inner diameter so as to apply a sufficient centrifugal force on the fibers in the low speed spinning rotor. However, recently, the rotation speed of spinning rotors has been increased to values of about two to three times 30,000 r.p.m. and accordingly the inner diameter of the spinning rotor has been decreased (this results in a decreased volume of the spinning rotor) to restrict the centrifugal force within favourable limits. Moreover, the fibers have had to be supplied at an increased rate to spin the same amount of yarn. These recent spinning conditions cause the fibers to overflow if they are supplied into a spinning rotor in which the yarn end connecting operation failed, and the spinning rotor to be clogged by the supplied fibers. Thus, there is the danger of disadvantages such as a fire occurring in the clogged spinning rotor due to frictional heat.

It is therefore a principal object of this invention to provide an open end spinning machine, in which a yarn breakage can be detected even during the transient conditions of the spinning machine and the supply of fibers into a spinning rotor can be stopped if a yarn end connecting operation has failed in the associated spinning rotor during the transient conditions.

SUMMARY OF THE INVENTION

In general, an open end spinning machine includes a plurality of spinning units according to this invention. With the above object in view, each spinning unit includes a first yarn breakage sensing device assuming a yarn sensing, operative position, in which it contacts the yarn when the spinning unit is in a normal spinning operation and an inoperative position, in which it is not in contact with the yarn, when the spinning units are in a transient condition either from or to the normal spinning operation, and a second yarn breakage sensing device assuming a yarn sensing position at least when the spinning unit is in the transient condition. Upon occurrence of the yarn breakage while the spinning unit is in the transient condition, the yarn breakage is detected by the second yarn breakage sensing device and the supply of fibers to the associated spinning unit is interrupted by the second yarn breakage sensing device.

BRIEF DESCRIPTION OF THE DRAWINGS

This invention will become more readily apparent from the following description of preferred embodiments shown, by way of example only, in the accompanying drawings, wherein.

DESCRIPTION OF THE PREFERRED EMBODIMENTS

Figure 1:
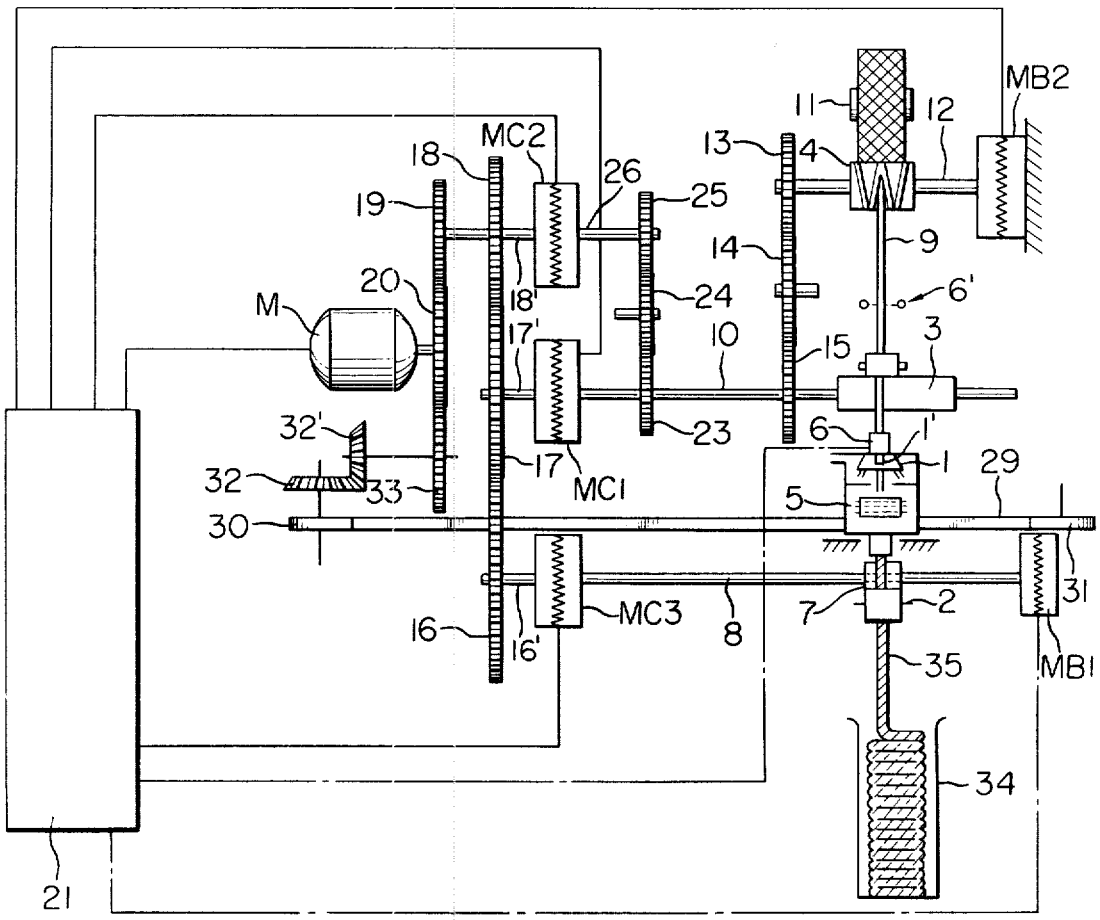
FIG. 1 is a fragmentary schematic view showing a portion of a prior art spinning machine to which this invention is applied.

Referring to FIG. 1, there is shown a drive transmission mechanism of a prior open end spinning machine similar to that described in U.S. Pat. No. 3,354,626 and this invention can be applied to such a spinning machine. Although only one spinning unit is shown in FIG. 1, the spinning machine normally comprises a number of spinning units along each side of the spinning machine, and yarn ending operations are simultaneously effected in all the spinning units on starting the machine.

Each spinning unit comprises a spinning rotor 1 into which opened fibers are supplied and formed into a yarn 9, means for feeding a sliver or roving 35 from a can 34, means for opening the sliver 35 into individual fibers and supplying them into the spinning rotor 1, means for taking up the yarn 9, and a winding roller 4 for winding the yarn 9 onto a bobbin 11. The feeding means comprises lower and upper feeding rollers 2 and 7 forming a nip therebetween, through which the sliver 35 is fed. The fiber opening and supplying means comprises a combing roller 5 of the well known type. The take-up means 3 includes a lower take-up roller and an upper take-up roller driven by the lower roller. The spinning rotor 1 may be of either the self-discharge type, wherein air in the interior of the spinning rotor is discharged through openings provided in the bottom of the spinning rotor due to its rotation, or the forced-discharge type, wherein air in the interior of the spinning rotor is discharged through an intake system (not shown) disposed outside of the spinning rotor. In any case, a subatmospheric pressure is produced in the interior of the spinning rotor 1 during rotation and the individual fibers opened by the combing roller 5 are thereby drawn into the interior of the spinning rotor 1.

The take-up means further includes a yarn take-up tube 1' disposed between the take-up roller 3 and the spinning rotor 1 so as to be in air communication with the latter. As is well known, the individual fibers are twisted into the yarn end in the spinning rotor 1 and the resultant yarn 9 is taken up from the spinning rotor 1 through the take-up tube 1' by the take-up rollers 3. Although only one pair of take-up rollers 3 is shown, all the lower take-up rollers equal in number to the number of spinning units, are mounted on a common driving shaft 10 mounted for rotation in the frame of the spinning machine. The winding roller 4, which has crossing grooves, is in driving relationship with the bobbin 11 to wind a package thereon in a cross winding manner. All the winding rollers 4 of the spinning units are attached to a driving shaft 12 rotatably mounted in the machine frame and controlled by an electromagnetic brake MB2 in a manner as discussed below.

To detect a yarn breakage, a first and a second yarn breakage detecting device 6 and 6', both of which form part of this invention, are provided respectively adjacent the yarn outlet of the yarn take-up tube 1' and in a position between the take-up roller 3 and the winding roller 4. In this embodiment, the second yarn breakage detecting device 6' is of the non-contact type, for example, a phototube unit capable of detecting the yarn breakage without contacting the yarn. Such a non-contact type yarn breakage detector may be disposed at any position between the yarn outlet of the yarn take-up tube 1' and the winding roller 4.

The driving shaft 12 is rotated through a train of gears 13, 14 and 15 by the driving shaft 10 in the same direction as the shaft 10.

Also, all the sliver feed rollers 7 are mounted on a common driving shaft 8 connected through a sliver feed electromagnetic clutch MC3 (hereinafter referred to as the "feed clutch") with a shaft 16' supporting a gear 16, which is driven through a train of gears 17, 18, 19 and 20 by an electric motor M and controlled by an electromagnetic brake MB1 as discussed below. The shaft 10 for driving the take-up rollers 3 is connected through an electromagnetic clutch MC1 with a shaft 17' supporting the gear 17. The clutch MC1 is hereinafter referred to as the "reverse clutch" because the yarn is fed in a reverse direction when the clutch MC1 is in engagement. To rotate the shaft 10 in a forward direction, the gear 18 supported by a shaft 18' is connected through an electromagnetic clutch MC2 and a train of gears 23, 24 and 25 with the shaft 10. The gear 23 is mounted on the shaft 10 so as to be positioned between the reverse clutch MC1 and the gear 15. The gear 23 meshes with the intermediate gear 24, which meshes in turn with the gear 25 supported by a shaft 26. The shaft 26 is connected to a driven member of the clutch MC2. The clutch MC2 is hereinafter referred to as the "forward clutch," because the yarn is fed in a forward direction when it is in engagement.

Mounted around a pair of pulleys 30 and 31 is an endless belt 29, which is in driving relationship with all the spinning rotors 1 in a conventional manner so that all the spinning rotors 1 are simultaneously rotated in the same direction. The pulley 30 is driven through a train of gears 32, 32', 33 and 20 by the motor M.

Therefore, it will be understood that in this embodiment all the spinning units are driven by the single motor M and their operation is controlled by controlling the motor M, forward clutch MC2, reverse clutch MC1, feed clutch MC3, electromagnetic brakes MB1 and MB2, and yarn breakage sensing devices 6 and 6' by means of a control apparatus 21.

Figure 2:
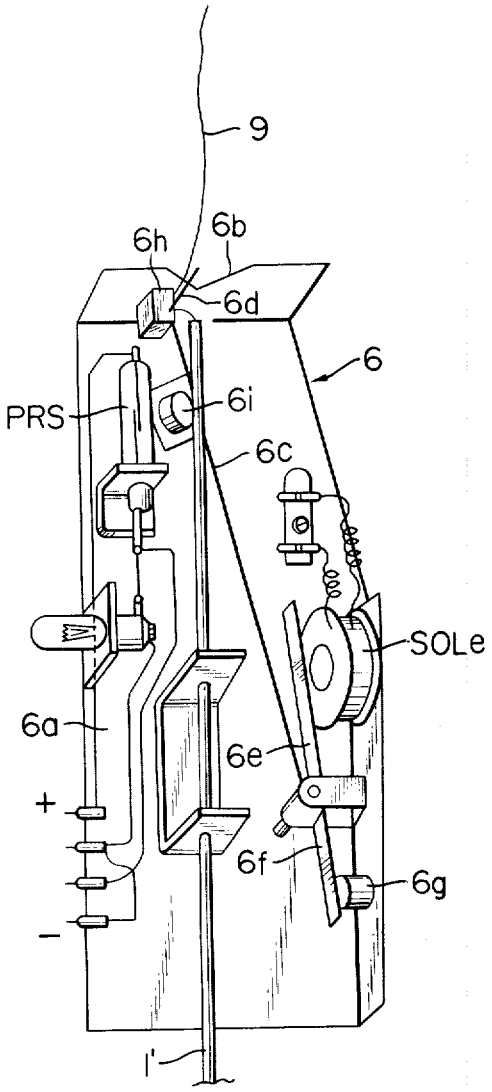
FIG. 2 is a perspective view of a yarn breakage sensing device employed in the embodiment of this invention.
Figure 3A:
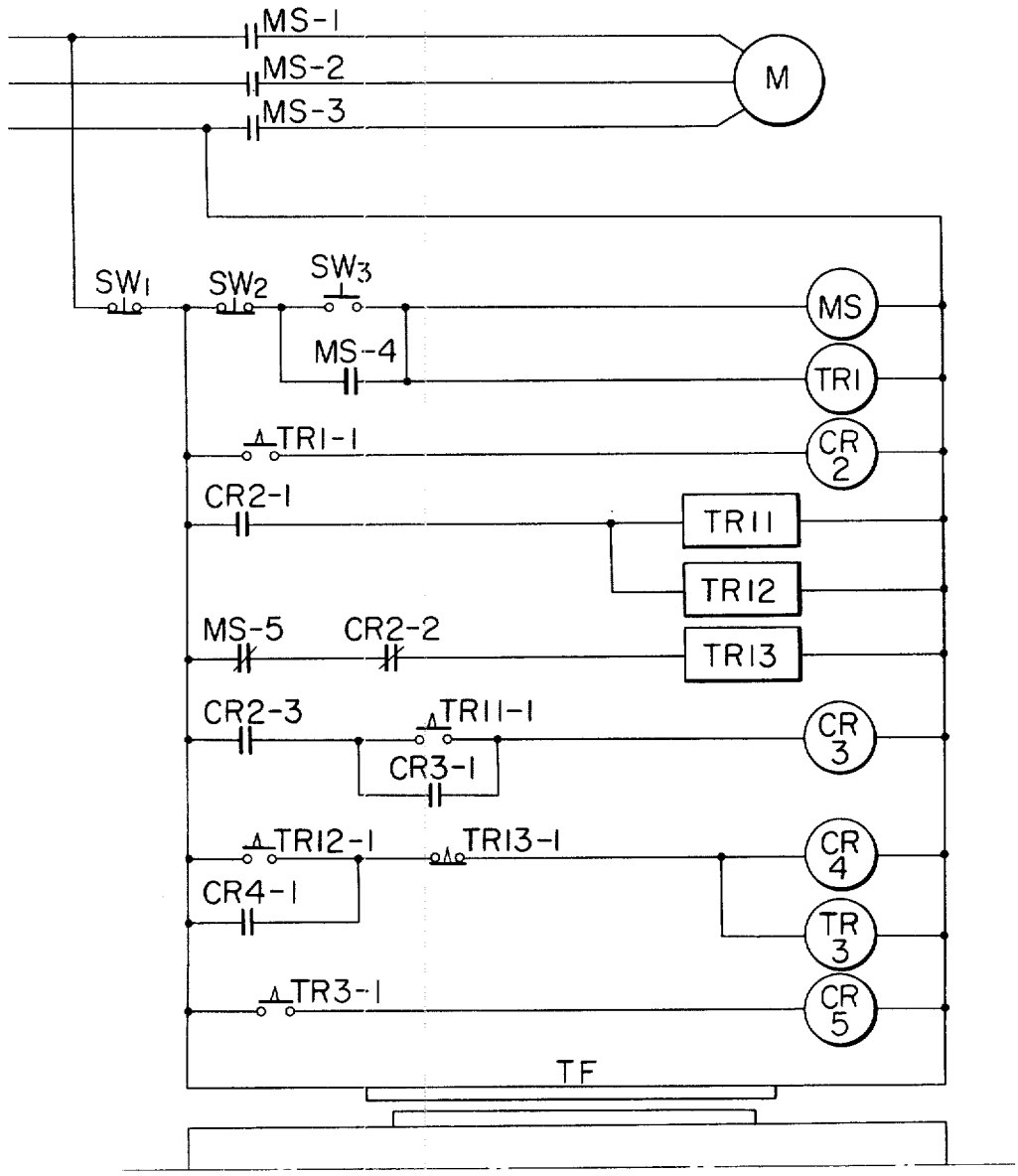
FIGS. 3A and 3B illustrate a suitable electric circuit for operating spinning units in accordance with this invention.
Figure 3B:
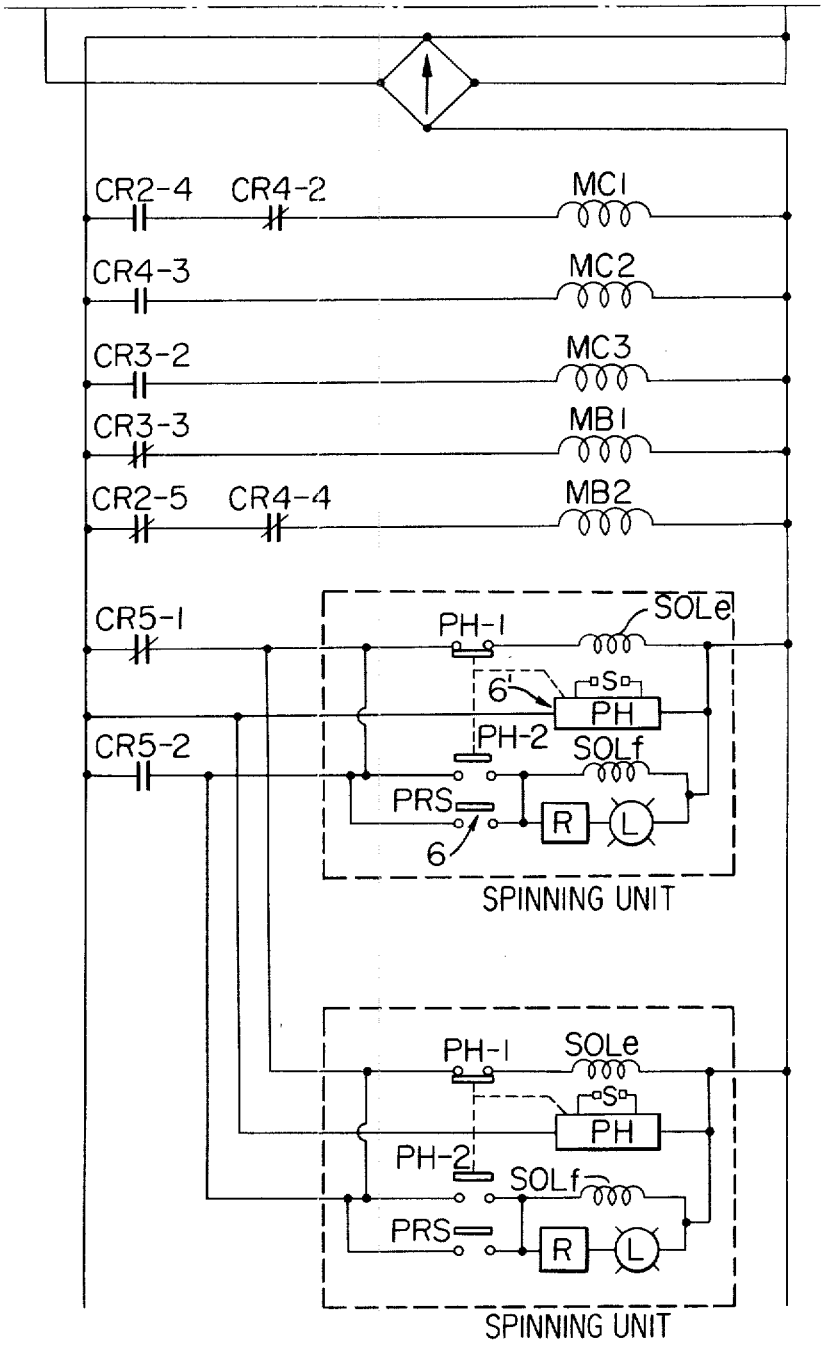

Details of the yarn breakage sensing device 6 and the control apparatus 21 are shown respectively in FIG. 2 and FIGS. 3A and 3B. In FIG. 2, there is shown a yarn breakage sensing device, which is similar to that disclosed in British Pat. No. 1,158,623. The sensing device includes a base plate **6*a* provided with a V-shaped guide notch 6*b*, adjacent to which the upper end of the take-up tube 1' extends upwardly, and a yarn sensing lever 6*c* pivotably connected with the base plate 6*a*. The yarn sensing lever 6*c* is provided with oppositely extending plate-like arms 6*e* and 6*f* made of suitable known ferromagnetic material and associated respectively with an electromagnet SOLe and a permanent magnet 6*g*. When the magnet SOLe is energized, it attracts the arm 6*e* and causes the lever 6*c* to turn from a yarn breakage position (shown in FIG. 2) into a righthandmost inoperative position (not shown). In the yarn breakage position, the lever 6*c* abuts at its upper end 6*d*** against an elastic support block 6*h* to hold the yarn 9 therebetween. When the lever 6*c* turns toward the yarn breakage position, the lower arm 6*f* is attracted by the permanent magnet 6*g* thereby to urge the lever 6*c* into the yarn breakage position. This ensures that the lever 6*c* provides an increased pressure against the support block 6*h* to firmly hold the yarn 9.

When the spinning machine is stopped, the fiber feeding means is first stopped to discontinue the supply of fibers to the spinning rotors. At that time, yarn breakage occurs in each of the spinning rotors or a lowering of tension of the yarn occurs due to the discontinuance of fiber supply and therefore the lever 6*c* is turned into the yarn breakage position in which its end 6*d* elastically holds the yarn end in cooperation with the support block 6*h* before the yarn end moves out of the take-up tube 1'. When the lever 6*c* is in this position, a magnet 6*i* mounted thereon causes a reed switch PRS to be closed thereby to energize the electromagnet SOLe under the control of the control apparatus 21 as described in detail hereinafter, whereupon the electromagnet SOLe attracts the upper arm 6*e* against the action of the permanent magnet 6*g*, this causing the lever 6*c* to be moved into the righthandmost position (in which it does not contact with the yarn) and the yarn end held by the lever 6*c* to be released. Such movements of the levers 6*c* to the righthandmost position occur simultaneously in all of the spinning units. Therefore, when the spinning machine is re-started with the levers 6*c* maintained in the righthandmost position, fibers will be supplied simultaneously into all the spinning rotors regardless of whether or not a particular yarn ending operation has been achieved successfully, if the second yarn breakage detecting device 6' according to this invention were not provided for each spinning unit. This results in the aforementioned disadvantages.

A suitable form of the control apparatus 21 and its operation are described below in conjunction with FIGS. 3A and 3B.

The vertical lines labelled respectively with a plus symbol (+) and a minus symbol (−) represent the positive and negative sides of a source of current, and the various elements constituting the control apparatus 21 in this embodiment of the invention are connected in the manner shown in FIGS. 3A and 3B. A power on-off switch $SW_1$, stop pushbutton $SW_2$ and start pushbutton $SW_3$ are in series with each other. These switches are in the on state, i.e., closed during spinning operation of the spinning machine.

When the spinning machine is stopped, the stop pushbutton $SW_2$ is turned off with the pushbuttons $SW_1$ and $SW_3$ maintained in the on state, whereupon a motor switch relay MS is deenergized to open its contacts MS-1 to MS-3 thereby causing the motor M to rotate by inertia. Simultaneously, contacts MS-4 are opened to deenergize a timer TR1, whereby its contacts TR1-1 are opened to deenergize a relay CR2. By the opening of normally open contacts CR2-3, a relay CR3 is deenergized to open the normally open contacts CR3-2 and close the normally closed contacts CR3-3, whereby the supply clutch MC3 and supply brake MB1 both connected to the shaft 8 (FIG. 1) are brought into the off state and on state respectively, stopping the supply of fibers. On the other hand, since the normally closed contacts MS-5 and CR2-2 are closed simultaneously with the deenergization of the relays MS and CR2, a timer or time counter TR13 for a delayed operation of the electromagnetic brake MB2 associated with the winding shaft 12 (FIG. 1) starts to count to a set time. When it counts up the set time, the normally closed contacts TR13-1 cause a control relay CR4 to be deenergized, whereupon the normally open contacts CR4-3 are opened to bring the forward clutch MC2 into the off state and the normally closed contacts CR4-4 are closed to bring the winding shaft brake MB2 into the on state. Thus, the spinning machine is topped.

Due to the afore-mentioned discontinuance of fiber supply, yarn breakage or reduction of yarn tension occurs before the stoppage of the spinning machine. At that time, the yarn sensing levers 6*c* of the first yarn breakage sensing devices 6 in all of the spinning units, which have been maintained in a yarn sensing position during normal spinning operation, are turned to the lefthandmost, yarn breakage position shown in FIG. 2 by the assistance of the permanent magnet 6*g* attracting the lower arm 6*f* thereto. This causes the reed switch PRS to be closed by the permanent magnet 6*i* mounted on each lever 6*c*, thereby energizng a solenoid $SOL_f$ to bring a known supply clutch (not shown) out of engagement, which is provided for each of the fiber supply means 2 and normally in engagement to allow the associated fiber supply means 2 to supply the fibers into the corresponding spinning rotor 1. Thus, the fiber supply is prevented in all of the spinning units, in which the levers 6*c* are in the yarn breakage position shown in FIG. 2.

With respect to the second yarn breakage sensing device 6', it is apparent from FIG. 3B that the device 6' comprises a photoelectric cell PH capable of always sensing yarn breakage. Even if the yarn breakage occurs on stopping or starting the spinning machine, this photoelectric cell PH disposed above the take-up roller 3 is not responsive to yarn breakage so far as the yarn end resulting from the yarn breakage remains at least in the yarn take-up tube 1'. This allows a switch PH-1 of the photoelectric cell PH to be maintained closed. Therefore, the solenoid SOLe for attracting the lever 6*c* thereto can be energized to bring the lever 6*c* into the righthandmost, inoperative position, whereby the reed switch PRS is opened to deenergize the solenoid SOLf in each spinning unit, thus bringing the supply clutch (not shown), provided for each of the fiber supplying means 2, into engagement. However, in the case where the resultant yarn end in a specific spinning unit is wound up on the associated winding roller 4 for some reason, the second yarn breakage sensing device 6' can detect this condition and causes its switch PH-1 to be opened thereby to prevent the energization of the solenoid SOLe for attracting the lever 6*c* thereto. Therefore, the lever 6*c* only in the specific spinning unit can be maintained in the yarn breakage position shown in FIG. 2 and the solenoid SOLf only in such specific spinning unit is energized to bring the associated supply clutch out of engagement, preventing the fiber supply to the specific spinning unit.

When the spinning machine is restarted from the above discussed stop condition, both the start and stop switches $WS_3$ and $SW_2$ are on to close the circuit. Because of this, the relay MS is energized to close the normally open contacts MS-1 to MS-4, whereupon the motor starts to rotate and the timer TR1 is picked up to count out the set time.

When the timer TR1 counts up the set time, the contacts TR1-1 are closed to energize the relay CR2 thereby closing the contacts CR2-1, whereupon both the timers TR11 and TR12 count to the set times, respectively, while the contacts CR2-4 are closed to bring the reverse clutch MC1 into the on state and the contacts CR2-5 are opened to bring the winding shaft brake MB2 into the off state. Thus, the take-up rollers 3 and winding rollers 4 are rotated in a reverse direction and the yarn ends can be pushed into the spinning rotors 1. When the timer TR11 counts up the set time, the contacts TR11-1 are closed to cause the relay CR3 to be energized through the closed contacts CR2-3 thereby to close the contacts CR3-2 and open the contacts CR3-3, whereupon the supply clutch MC3 common to all the spinning units is brought into engagement and the supply brake MB1 is brought out of engagement, thus allowing rotation of the fiber supply shaft 8. It is therefore understood that the fibers can be supplied into the spinning rotors 1 of all the spinning units, excepting a spinning unit in which the supply clutch provided for each fiber supply means 2 is out of engagement, and the yarn end connecting operations are carried out in the spinning rotors which have been supplied with the fibers.

When the timer TR12 for setting a time, at which the taking up of the yarn is to begin in timed relation with the afore-mentioned yarn ending, counts up the set time, its normally open contacts TR12-1 close to energize the relay CR4 through the normally closed contacts TR13-1 of a timer TR13 and the timer TR3 starts to count to a set time. Upon energization of the relay CR4, the contacts CR4-3 close to energize the forward clutch MC2 while the normally closed contacts CR4-2 and CR-4 open to deenergize both the reverse clutch MC1 and the winding shaft brake MB2. Thus, the take-up rollers 3 and winding rollers 4 are rotated in a forward direction so that the pulling out of the yarn 9 can be effected at a proper timing with respect to the connection of the yarn end with the fibers collected in the spinning rotor.

When the set time of the timer TR3 elapses, its contacts TR3-1 close to energize the relay CR5 thereby opening the normally closed contacts CR5-1 (FIG. 3B), whereupon the lever 6c, which has been attracted to the righthandmost, inoperative position by the solenoid SOLe energized through the closed contacts PH-1 due to the non-occurrence of the yarn breakage, is turned leftwardly in FIG. 2 by the deenergization of the solenoid SOLe and the action of the permanent magnet 6g and into the yarn sensing position in which the lever 6c contacts with the ended yarn 9 to detect yarn breakage. Moreover, since the normally open contacts CR5-2 close simultaneously with the opening of the contacts CR5-1, the reed switch PRS of the first yarn breakage sensing device 6 can detect the yarn breakage when it occurs.

It is assumed that a yarn end connecting operation has failed in a specific spinning unit during the aforementioned starting operation of the spinning machine until the set time of the timer TR3 elapses. In this case, the relay CR5 is not yet energized and the normally closed contacts CR5-1 are maintained closed. However, the photoelectric cell PH of the always operative, second yarn breakage sensing device 6' can detect the failure of the yarn end connecting operation or the yarn breakage and causes the switch PH-1 to open, whereupon the solenoid SOLe only in the specific spinning unit is deenergized to allow the lever 6c to turn to the yarn breakage position shown in FIG. 2. This causes the reed switch PRS to be closed. Since the switch PH-2 is closed upon the yarn breakage, the solenoid $SOL_f$ in the specific spinning unit is energized to bring the supply clutch for the specific spinning unit out of engagement. Thus, the fiber supply to the specific spinning unit can be prevented.

Furthermore, if a yarn breakage should occur in a specific spinning unit after the lapse of the set time of the timer TR3, i.e., during the normal spinning operation, the fiber supply to the specific spinning unit also can be stopped in the same manner as in the prior art upon the disengagement of the supply clutch for the specific spinning unit, which is caused by the closing of the reed switch PRS resulting from the turning of the lever 6c to the yarn breakage position shown in FIG. 2.

Although the first embodiment of this invention hitherto described employs, as the second yarn breakage sensing device 6', the photoelectric cell PH which is not in contact with the yarn to sense the latter, the second yarn breakage sensing device 6' may be of the same type as the first yarn breakage sensing device 6 which contacts with the yarn for sensing. In this case, an electric circuit for a control apparatus 21 may be formed substantially in the same manner and the second yarn breakage sensing device 6' is preferably disposed between the take-up roller 3 and the winding roller 4.

Figure 4:
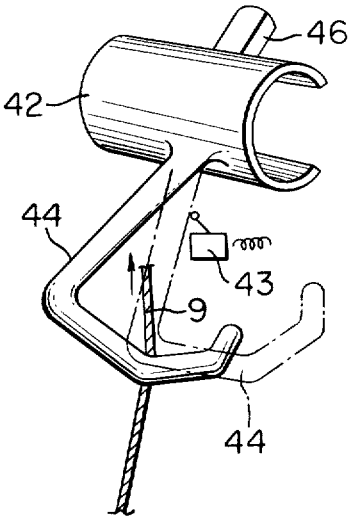
FIG. 4 is a perspective view showing a yarn breakage sensing device in a modified form.
Figure 5:
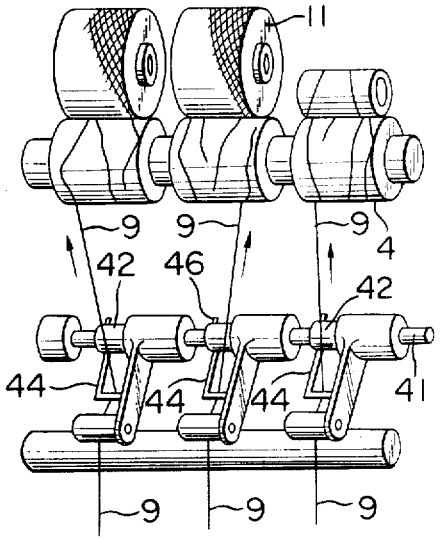
FIG. 5 is a perspective view of portion of the spinning machine provided with the yarn breakage sensing device shown in FIG. 4.

In an open end spinning machine including devices for regulating the winding tension of the yarn, each regulating device is available as a part of the second yarn breakage device 6'. For example, a regulating device of FIGS. 4 and 5 as disclosed in Japanese Laid-Open U.M. Specification No. 53-19046 comprises a tension regulating swing arm 44 having a semi-cylindrical portion 42 loosely mounted onto a horizontally extending shaft 41, and a balance weight 46 mounted on part of the portion 42 opposite to the arm 44 so that the balance weight 46 is positioned on the front side of a vertical plane including the center axis of the shaft 41 when the arm 44 is moved to the lowermost position thereof and on the back side of the vertical plane when the arm is moved to the uppermost position due to changes in the yarn tension. The balance weight 46 is adapted to provide a counter moment smaller than that of the arm 44. To detect a yarn breakage by using such a regulating device, a microswitch 43 is arranged beyond the range of swing of the arm 44 during the normal spinning operation and within the range of swing of the arm 44 when the yarn breakage occurs. If the yarn breakage should occur, the arm 44 will swing to the position shown by the dot and dash line in FIG. 4 to operate the microswitch 43. Thus, the yarn breakage occurring under the transient conditions of the spinning machine, i.e., during a stopping and starting operation, can be detected. It will be obvious to those skilled in the art to connect contacts of the microswitch 43 in a similar manner to the contacts PH-1 and PH-2 of the photoelectric cell PH shown in FIG. 3B.

Figure 6A:
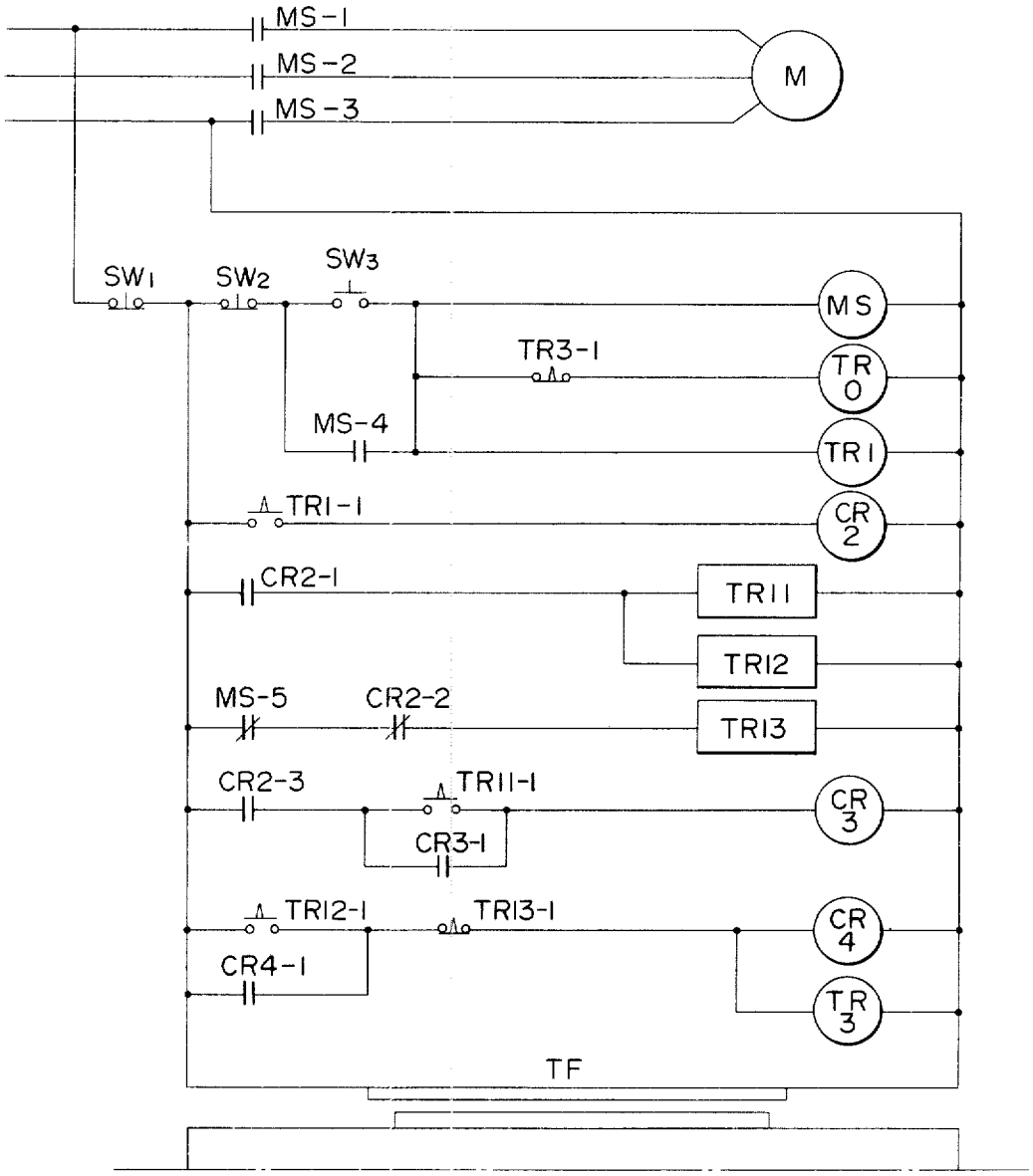
FIGS. 6A and 6B illustrate another modification of a suitable electric circuit for operating the spinning units in a different manner from the circuit shown in FIGS. 3A and 3B.
Figure 6B:
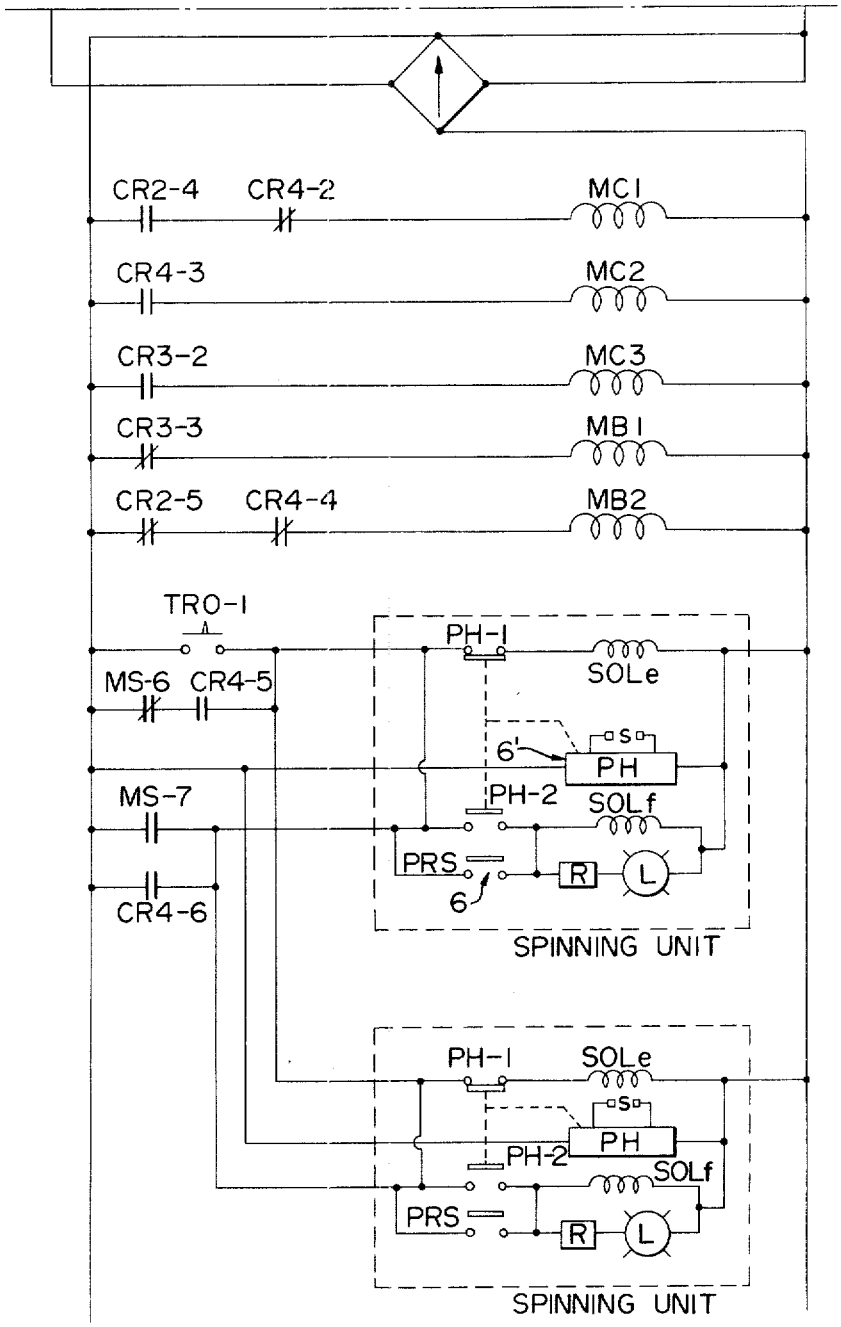

FIGS. 6A and 6B show an electric circuit for another embodiment of this invention, which is different from the circuit of FIGS. 3A and 3B in that the yarn end is adapted to be held between the block 6h and the end 6d of the lever 6c to prevent the occurrence of snarls in the yarn end. In FIGS. 6A and 6B, when the start switch $SW_3$ is pushed down to start the spinning machine, a timer TR0 starts to count to a set time and then the set time elapses to close the contacts TR0-1. At that time, if the second yarn breakage sensing device 6' is sensing the presence of yarn (i.e., switch PH-1 is being closed), the solenoid SOLe will be energized thereby to cause the lever 6c to turn from the yarn breakage position shown in FIG. 2 to the righthandmost, inoperative position. After the lapse of the set time of the timer TR0, the timer TR3 counts up the set time to open the normally closed contacts TR3-1 thereof, whereupon the timer TR0 is re-set and the solenoid SOLe is deenergized to release the lever 6c. Thus, the lever 6c is turned to the yarn sensing position. On stopping, the stop switch $SW_2$ is pushed down to stop the motor M. At the same time, the solenoid SOLe is energized to turn the lever 6c from the yarn breakage position to the righthandmost position. When the stopping operation is completed, the solenoid SOLe is deenergized to turn the lever 6c from the righthandmost position to the yarn breakage position to hold the yarn end between the block 6h and the end 6d of the lever 6c.

Therefore, it will be apparent from the foregoing that since each spinning unit according to this invention is provided with the second yarn breakage sensing device capable of sensing the yarn breakage even during the stopping and starting operations of the spinning machine, it is possible to completely prevent the unnecessary supply of fibers into the spinning rotor during such operations. Thus, there will occur no clogging of the spinning rotor by the fibers and the spinning unit is free from the danger of a fire and the disadvantages of reduction of the useful life of the parts, especially a spindle for the spinning rotor, due to contamination, damage and over-heating thereof.

Although preferred embodiments has been described above, it will be readily understood by those skilled in the art that this invention is equally applicable to other open end spinning machines having different constructions. For example, the spinning machine may employ a single electromagnetic clutch in lieu of the reverse and forward clutches MC1 and MC2. Also, the spinning rotors may be driven by a separate motor independent of the motor M, and the feeding of the yarn end in the reverse direction may be carried out by storing up an additional length of yarn between the take-up roller 3 and the take-up tube 1', when the spinning machine is stopped and releasing the stored yarn when it is necessary to feed the yarn end in the reverse direction, whereupon the released yarn is sucked into the spinning rotor by the subatmospheric pressure produced therein. Furthermore, the second yarn breakage sensing device 6' may utilize the principles employed in an Uster evenness tester, wherein a yarn is passed through a gap between capacitors forming a part of a high frequency circuit to determine changes in capacitance and the changes are detected by a resonance circuit.

What we claim is:

1. In an open end spinning machine including a plurality of spinning units, each said spinning unit including a spinning rotor for forming fibers into a yarn, and means for supplying fibers into said spinning rotor, the improvement wherein:

each said spinning unit includes first yarn break sensing means for detecting breakage of said yarn when said spinning machine is in a normal spinning operation and for stopping the respective said fiber supplying means in response thereto, and thus for preventing the respective said spinning rotor from being filled with fibers, said first yarn break sensing means assuming an operative yarn sensing position in contact with said yarn when said spinning unit is in a normal spinning operation, and said first yarn break sensing means assuming an inoperative position out of contact with said yarn when said spinning unit is in a transient condition either from or to the normal spinning operation; and each said spinning unit includes a second yarn break sensing means for detecting breakage of said yarn when said spinning machine is in said transient condition and for stopping the respective said fiber supplying means in response thereto, and thus for preventing the respective said spinning rotor from being filled with fibers, said second yarn break sensing means assuming a yarn sensing condition at least when said spinning unit is in said transient condition.

2. The improvement claimed in claim 1, wherein each said first yarn break sensing means comprises a yarn sensing lever movable to assume said operative and inoperative positions and a yarn breakage position when the yarn breakage occurs, a permanent magnet mounted on said yarn sensing lever, a reed switch arranged so as to be switched on by said permanent magnet when said yarn sensing lever assumes said yarn breakage position thereby to cause the respective said fiber supplying means to become inoperative, and a solenoid associated with said reed switch and said yarn sensing lever so that when said reed switch is switched on it is energized thereby to move said yarn sensing lever from said yarn breakage position to said inoperative position.

3. The improvement claimed in claim 2, further comprising means for, after said yarn sensing lever is moved from said yarn breakage position to said inoperative position, starting said fiber supplying means and connecting the yarn free end resulting from the breakage to the leading end of new yarn formed in said spinning rotor, and said second yarn break sensing means is operable to sense failure of said connecting said free end and to stop said fiber supplying means in response thereto.

4. The improvement claimed in claim 2, wherein said spinning unit includes means for deenergizing said solenoid when the transient condition from said normal spinning operation is completed, whereby said yarn sensing lever is moved from said inoperative position to said yarn breakage position to hold said yarn.

5. The improvement claimed in claim 4, wherein said spinning unit includes means for energizing said solenoid at a predetermined point of time during said transient condition to said normal spinning operation so that a yarn end resulting from the yarn breakage is held by said yarn sensing lever in said breakage position thereby to prevent the occurrence of snarls in said yarn end.

6. The improvement claimed in claim 1, further comprising means for stopping said spinning machine, whereby said fiber supplying means of all said spinning units are stopped, thus resulting in a yarn free end at each said spinning unit, and means thereafter for starting said spinning machine, whereby said fiber supplying means of said spinning units again supply fibers to said spinning rotors to form new yarn, and leading ends of said new yarn are connected to respective said free ends, and said second yarn sensing means of each said spinning unit is operable to sense failure of connection of the respective said free end and leading end.

7. The improvement claimed in claim 1, wherein each said second yarn break sensing means comprises a photoelectric tube unit through which the yarn to be sensed passes, said photoelectric tube unit being disposed in a position between a yarn take-up tube and a winding roller of the respective said spinning unit.

8. The improvement claimed in claim 1, wherein each said second yarn break sensing means comprises a swing arm loosely mounted on a horizontally extending shaft so as to be swingable with changes in tension of the respective yarn, and a microswitch arranged beyond the range of swing of said arm during the normal spinning operation of the respective said spinning unit and within the range of swing of said arm when the yarn breakage occurs, said microswitch being closed by said arm upon the occurrence of the yarn breakage thereby causing the respective said fiber supplying means to stop.

* * * * *